US008239981B2

(12) United States Patent
Epp et al.

(10) Patent No.: US 8,239,981 B2
(45) Date of Patent: Aug. 14, 2012

(54) GLASS OR GLASS-CERAMIC WASHBASIN

(75) Inventors: Bertrand Epp, Dannelbourg (FR); Serge DeZorzi, Walscheid (FR)

(73) Assignee: Schott VTF, Troisfontaines (FR)

( * ) Notice: Subject to any disclaimer, the term of this patent is extended or adjusted under 35 U.S.C. 154(b) by 1015 days.

(21) Appl. No.: 11/886,394

(22) PCT Filed: Mar. 10, 2006

(86) PCT No.: PCT/FR2006/050211

§ 371 (c)(1),
(2), (4) Date: Jun. 30, 2008

(87) PCT Pub. No.: WO2006/097653

PCT Pub. Date: Sep. 21, 2006

(65) Prior Publication Data

US 2009/0094738 A1 Apr. 16, 2009

(30) Foreign Application Priority Data

Mar. 14, 2005 (FR) ..... 05 02486

(51) Int. Cl.
*A47K 1/04* (2006.01)

(52) U.S. Cl. ..... 4/616; 4/623

(58) Field of Classification Search ..... 4/619, 623, 4/643

See application file for complete search history.

(56) References Cited

U.S. PATENT DOCUMENTS 2,314,157 A * 3/1943 O'Brien ..... 4/631
3,993,376 A * 11/1976 Meldahl ..... 312/228
4,305,166 A * 12/1981 Rose ..... 4/631
5,819,335 A 10/1998 Hennessy et al.

FOREIGN PATENT DOCUMENTS

EP 1422352 * 11/2003

* cited by examiner

*Primary Examiner* — Davis Hwu
(74) *Attorney, Agent, or Firm* — The Watson I.P. Group, PLC; Jovan N. Jovanovic; Vladan M. Vasiljevic

(57) ABSTRACT

The invention relates to a glass or glass-ceramic washbasin. The inventive washbasin is characterized in that it essentially comprises at least one part (1) which forms a water receptacle and which is made from glass or glass-ceramic and at least one part (2) which prevents the water from flowing from the first part (1). In addition, the assembly is provided with a water drain hole (3). The aforementioned first part (1) is equipped with a groove (2') for receiving the lower edge of the second part (2) and said two parts (1 and 2) are assembled by means of a glue that is injected into the base of the groove (2') prior to assembly. The invention is particularly suitable for household equipment, such as washbasins that are made from glass or glass-ceramic.

20 Claims, 2 Drawing Sheets

GLASS OR GLASS-CERAMIC WASHBASIN

The present invention concerns the field of household equipment, in particular washbasins, such as washbasins that are made from glass or glass-ceramic, and has for its object such a washbasin formed by parts assembled by gluing.

Currently, washbasins of this type used in the field of household equipment are generally made of glass of any kind and are sometimes hardened. For this purpose, the shaping of these washbasins is done by casting and the parts obtained often have the disadvantage of being relatively fragile, while having relatively large wall thicknesses, and are thus, in addition, of a relatively high weight.

In addition, the making of washbasins from glass by casting involves a relatively costly manufacturing procedure which significantly encumbers the production costs of such washbasins. Thus, by U.S. Pat. No. 5,819,335 such a cast washbasin is known, in which elements joined by gluing, such as a rim, allow, in particular, the arrival and flow of water to be hidden. However, this document does not in any way envisage the making of a washbasin by assembly of glass parts.

The present invention has for its object to overcome the disadvantages of washbasins of this type by proposing a washbasin made of glass or glass-ceramic which can be made simply and rapidly while presenting better mechanical resistance.

For this purpose, the washbasin in accordance with the invention is characterized in that it is essentially constituted by at least one part forming a water receptacle, made of glass or glass-ceramic, and by at least one part which prevents the water from flowing from the first part forming a receptacle, the assembly being provided with a water drainage hole and the part forming a water receptacle being provided with a groove for receiving the lower edge of the retaining part, the assembly of the two parts being maintained by means of glue injected into the bottom of the groove before assembly.

The invention will be better understood thanks to the above description, which concerns a preferred embodiment given by way of non-limiting example and is explained with reference to the annexed schematic diagrams, in which.

Figure 1:
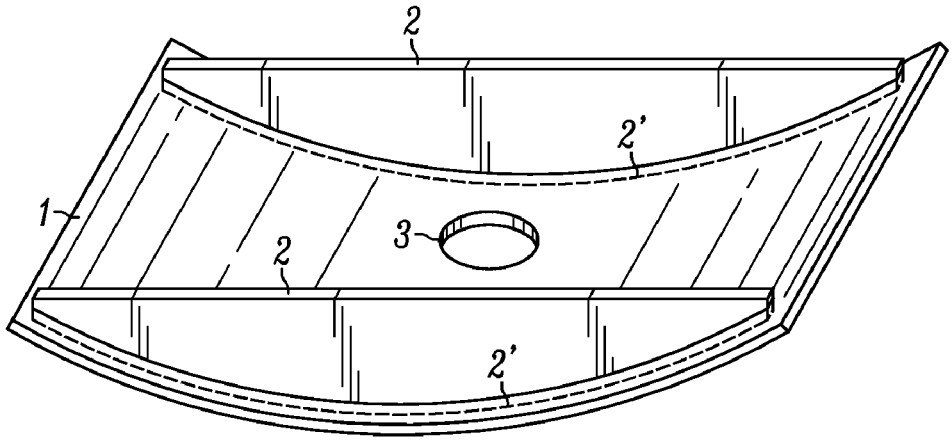
FIG. 1 is a perspective view of a first embodiment of the invention.
Figure 3:
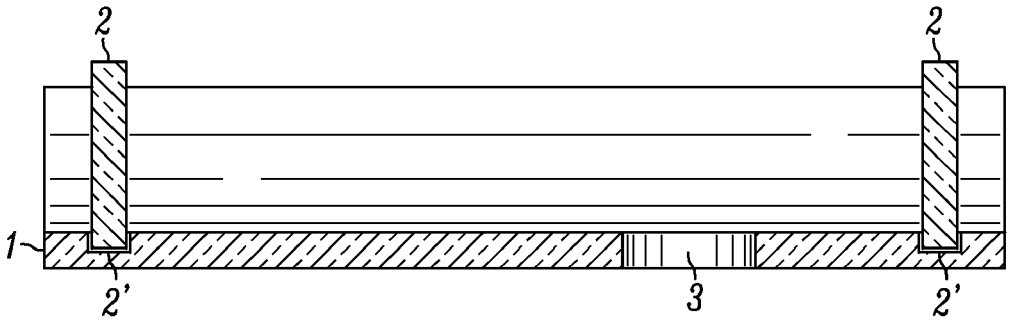
FIG. 3 is a cross-sectional view of the first embodiment of the invention.

FIG. 1 and FIG. 3 of the annexed diagrams represent a glass or glass-ceramic washbasin which is essentially constituted by at least one part 1 forming a water receptacle, in glass or glass-ceramic, and by at least one part 2 which prevents the water from flowing from the first part forming a receptacle, the assembly being provided with a water drainage hole 3 and held together with glue.

Part 1 forming a water receptacle, in glass or glass-ceramic, is preferably presented in the form of a part incurvated in at least one direction, and part 2 for retaining the water is fixed on part 1 parallel to the direction of curvature of this part 1. Preferably, part 1 is provided with a groove 2' for receiving the lower edge of part 2 and the assembly between part 1 and part 2 is maintained by means of glue injected into the bottom of groove 2' before assembly.

The realization of a washbasin with two parts 1 and 2, as described above, supposes that part 1 is slightly inclined with regard to the horizontal with a slope in the direction of part 2 forming the reservoir for the water. In such a case, the water drainage hole 3 is advantageously provided close to groove 2' for receiving part 2 or can be directly effected in part 2. These possible dispositions of the hole 3 are not represented in FIG. 1.

According to a variant embodiment of the invention and as shown in FIG. 1 of the annexed diagrams, the retention of water in part 1 forming a water receptacle can be obtained by providing two parts 2 for retaining the water disposed in parallel in the grooves 2', parallel to the direction of curvature of part 1, close to the corresponding edges of said part 1, hole 3 being then disposed centrally with relation to the parts 2.

Part 1 is advantageously realized by deformation under heat on a template followed by tempering. Part or parts 2 are for their part preferentially realized in tempered safety glass or in another material of mineral, metallic or synthetic origin.

In accordance with another characteristic of the invention, not represented in the annexed diagrams, the washbasin may also be constituted by a part 1 forming a water receptacle, in glass or in glass-ceramic, on which are assembled at least three parts 2 for retaining the water mounted in the grooves 2' provided in part 1 and connected to each other at their extremities. In such a case, part 1 can be presented in the form of a flat piece with a water drainage hole 3 disposed centrally or in a random manner, a slight declivity or small drainage channels being simply provided from parts 2 in the direction of hole 3. It is also possible to provide, with such a flat part 1, a drainage hole effected in one of the parts 2, the evacuation channels provided in part 1 being then oriented in the direction of this hole.

Figure 2:
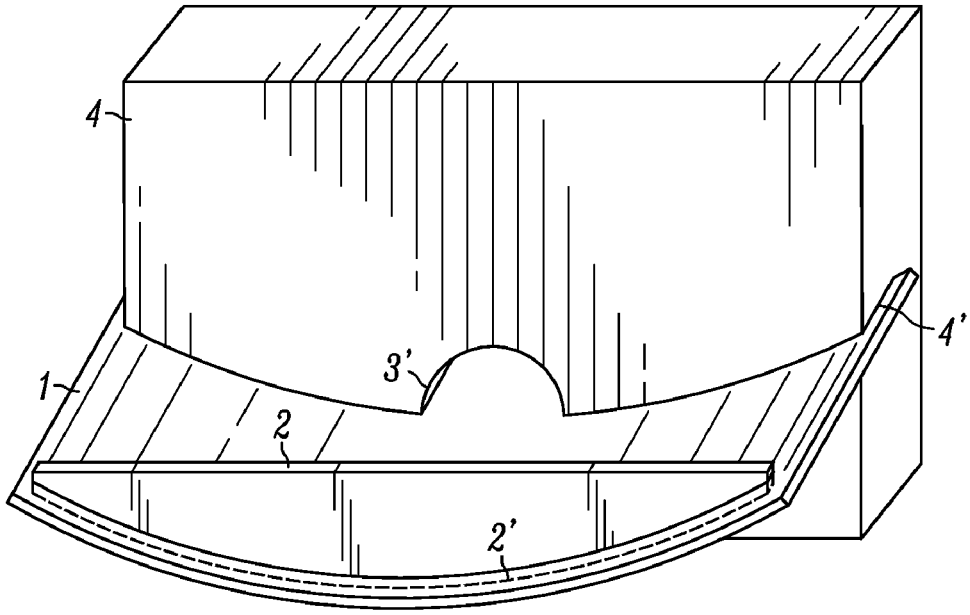
FIG. 2 is a perspective view of a variant embodiment of the invention.

FIG. 2 of the annexed diagrams represents another variant embodiment of the invention, in which part 1 forming a water receptacle, in glass or glass-ceramic, is mounted on a console 4 of a material of mineral, metallic or synthetic origin by insertion in a groove 4' of said console 4 and glued into the latter, a water drainage hole 3' being effected in said console 4 in prolongation of the junction between part 1 and console 4. In such an embodiment, the water drainage hole 3' is presented in the form of a channel traversing console 4 to be connected behind said console 4 to a conduit of known type, the part of hole 3' opening at the front of console 4 at the level of part 1 following, at its lower part, the contour of said part 1. Console 4 may also be constituted directly by a support wall of the washbasin.

Part 2 for retaining the water extends parallel to console 4, on the side of part 1 opposite that where it is mounted on said console 4. It is also possible, in the case of mounting part 1 with a slight inclination in the direction of console 4, not to provide part 2 for retaining the water, the latter naturally having a tendency to flow directly toward the console.

According to another variant embodiment of the invention, not represented in FIG. 2 of the annexed diagrams, several parts 2 for retaining the water can be mounted on part 1 forming a water receptacle, two of these parts 2 being connected at one end to console 4 and at the other end, either directly to each other or to the end of at least one other part 2 for retaining the water. It is thus possible to make a washbasin of which part 1 forming the water receptacle is provided with any geometric shape whatsoever, conferred by the parts 2.

According to another characteristic of the invention, part 1 in glass or glass-ceramic can be decorated on one or both faces by a serigraphic coating of vitrified enamel. Thus, part 1 can present personalized decoration, a brand or other decorative motif.

Likewise, the water retaining parts 2 can also be provided with decoration in the form of a serigraphic or other type of coating.

Thanks to the invention it is possible to make washbasins of glass or glass-ceramic which can be assembled from simple elements offering good mechanical resistance while having relatively small thicknesses, which is a considerable advantage from the esthetic point of view for the washbasins so made.

Furthermore, by the very fact of their assembly from different elements, the washbasins thus obtained also present increased resistance, as the different individual parts can be submitted to preliminary treatments to improve their resistance.

Of course, the invention is not limited to the embodiment described and represented in the annexed diagrams. Modifications are possible, particularly from the point of view of the constitution of the various elements or by substitution of equivalent techniques, without thereby straying from the field of protection of the invention.

The invention claimed is:

1. A washbasin made from glass or glass-ceramic characterized in that it is essentially constituted by at least one part (1) having an upwardly concave configuration forming a water receptacle, made of glass or glass-ceramic, and by at least one part (2) which fixedly extends upwardly from an upper surface of the part (1) which prevents water from flowing from the first part (1) and which together with the part (1) forming a receptacle for the retention of water, the assembly being provided with a water drainage hole (3) and part (1) being provided with a groove (2') having a bottom, the groove (2') formed into the upper surface thereof and structurally configured for receiving a lower edge of part (2), so that the part (2) extends upwardly therefrom, wherein an assembly between part (1) and part (2) being maintained by means of a glue injected into the bottom of groove (2') before assembly, wherein the glue maintains a substantially fluid tight bond between the part (1) and the part (2).

2. A washbasin, following claim 1, characterized in that part (1) forming a water receptacle, in glass or glass-ceramic, is presented in the form of a part incurvated in at least one direction.

3. A washbasin, following claim 1, characterized in that part (2) for retaining the water is fixed on part (1) parallel to the direction of curvature of this part (1).

4. A washbasin, following claim 1, characterized in that part (1) is slightly inclined with regard to the horizontal with a slope in the direction of part (2) forming the reservoir for the water.

5. A washbasin, following claim 1, characterized in that the water drainage hole (3) is provided close to groove (2') for receiving part (2).

6. A washbasin, following claim 1, characterized in that the water drainage hole (3) is effected directly in part (2).

7. A washbasin, following claim 1, characterized in that two parts (2) for retaining the water are disposed in parallel in the grooves (2'), parallel to the direction of curvature of part (1), close to the corresponding edges of said part (1), hole (3) being disposed centrally with relation to the parts (2).

8. A washbasin, following claim 1, characterized in that part (1) is realized by deformation under heat on a template followed by tempering.

9. A washbasin, following claim 1, characterized in that part or parts (2) are realized in tempered safety glass or in another material of mineral, metallic or synthetic origin.

10. A washbasin, following claim 1, characterized in that it is constituted by a part (1) forming a water receptacle, in glass or in glass-ceramic, on which are assembled at least three parts (2) for retaining the water, mounted in the grooves (2') provided in part (1) and connected to each other at their extremities.

11. A washbasin, following claim 10, characterized in that part (1) is presented in the form of a flat piece with a water drainage hole (3) disposed centrally or in a random manner, a slight declivity or small drainage channels being simply provided from parts (2) in the direction of hole (3).

12. A washbasin, following claim 10, characterized in that part (1) is presented in the form of a flat piece with a slight declivity or small drainage channels extending in the direction of a water drainage hole effected in one of the parts 2.

13. A washbasin, following claim 1, characterized in that part (1) forming a water receptacle, in glass or glass-ceramic, is mounted on a console (4) of a material of mineral, metallic or synthetic origin by insertion in a groove (4)' of said console (4) and glued into the latter, a water drainage hole (3)' being effected in said console (4) in prolongation of a junction between part (1) and console (4).

14. A washbasin, following claim 13, characterized in that the water drainage hole (3') is presented in the form of a channel traversing console (4) to be connected behind said console (4) to a conduit of known type, the part of hole (3') opening at the front of console (4) at the level of part (1) following, at its lower part, the contour of said part (1).

15. A washbasin, following claim 1, characterized in that part (2) for retaining the water extends parallel to console (4), on the side of part (1) opposite that where it is mounted on said console (4).

16. A washbasin, following claim 13, characterized in that in the case of mounting part (1) with a slight inclination in the direction of console (4), no part (2) for retaining the water is provided.

17. A washbasin, following claim 1, characterized in that several parts (2) for retaining the water are mounted on part 1 forming a water receptacle, two of these parts (2) being connected at one end to console (4) and, at the other end, either directly to each other or to the end of at least one other part (2) for retaining the water.

18. A washbasin, following claim 13, characterized in that console (4) is constituted directly by a support wall of the washbasin.

19. A washbasin, following claim 1, characterized in that part (1) in glass or glass-ceramic is decorated on one or both faces by a serigraphic coating of vitrified enamel.

20. A washbasin, following claim 1, characterized in that the parts (2) for retaining the water are provided with decoration in the form of a serigraphic or other type of coating.

* * * * *